US005109617A

United States Patent [19]

Nummy

[11] Patent Number: 5,109,617

[45] Date of Patent: May 5, 1992

[54] SAND TRAP RAKE ACCESSORY FOR GOLF SHOES

[76] Inventor: William R. Nummy, 711 W. Meadowbrook, Midland, Mich. 48640

[21] Appl. No.: 697,431

[22] Filed: May 9, 1991

[51] Int. Cl.[5] ..... A43B 5/00

[52] U.S. Cl. ..... 36/132; 36/136; 36/127

[58] Field of Search ..... 36/136, 132, 127

[56] References Cited

U.S. PATENT DOCUMENTS

| | | | |
|---|---|---|---|
| 997,055 | 7/1911 | Gilowitz | 36/134 |
| 3,346,971 | 10/1967 | Kiwala | 36/136 |
| 3,731,405 | 5/1973 | Kincaid | 36/134 |
| 4,073,075 | 2/1978 | O'Brien | 36/127 |
| 4,198,771 | 4/1980 | Foster | 36/136 |
| 4,693,022 | 9/1987 | Terhune | 36/136 X |

*Primary Examiner*—Paul T. Sewell
*Assistant Examiner*—Ted Kavanaugh
*Attorney, Agent, or Firm*—William Miller Yates

[57] ABSTRACT

An accessory for attachment to a golf shoe provides for smoothing out depressions in golf course sand traps. The accessory comprises a small rake mounted transverse to the shoe and rearward of the heel. The mounting may include a pivot allowing adjustment of the rake from a lowered position in raking contact with the ground to a raised position clear of the ground. A manually adjustable lock for the pivot permits securing the rake selectively in lowered or raised position. The mounting is held to the shoe by one or more prongs drive-fitted into the heel or by a spur assembly encircling the heel and strapped to the shoe.

7 Claims, 1 Drawing Sheet

SAND TRAP RAKE ACCESSORY FOR GOLF SHOES

FIELD OF THE INVENTION

This invention relates to golf shoes. It particularly concerns, as an accessory for attachment to a golf shoe, an adjustable rake for smoothing out depressions in golf course sand traps.

BACKGROUND

On golf courses, a common built-in hazard is the sand trap or sand bunker. With such a trap, it is important that the surface of the sand be kept smooth at all times the course is in use. In this way, a later player haplessly hitting into the trap does not face a further disadvantage of having the ball roll into a footprint or other depression or disturbance left in the sand by a previous player. Thus, as a matter of courtesy, every player entering into a trap is expected on leaving to rake the surface of the sand back to a smooth state. Golf courses generally place a rake near each trap ready for such use. However, there is often frustration in that the rake may be out of place, missing, broken, or otherwise ineffective. Moreover, some golfers so resent the whole raking operation that they do it poorly or not at all. These and other players need or would welcome means of keeping smooth the surface of sand traps which is sufficiently simple, quick, and easily adjusted to be readily accepted and used.

SUMMARY OF THE INVENTION

In the present invention, a device for smoothing the sandy surface of a golf course sand trap is provided in the form of a raking accessory attached to each shoe worn by a golfer. The accessory comprises a small rake about the width of the heel of the shoe and a mounting for the rake adapted to hold it in place transverse to the shoe and rearward of the heel. The mounting may include a pivot allowing adjustment of the rake from a lowered position in raking contact with the ground to a raised position clear of the ground. A manually adjustable lock for the pivot permits securing the rake selectively in lowered or raised position.

In use, the player adjusts the rake accessories to the lowered position and strides over the footprints or other depressions in the sane. The lowered rakes scrape the sand and quickly smooth it over. By changing the rakes to the raised position, scraping is discontinued and the player is free to walk about normally.

DESCRIPTION OF THE DRAWINGS

The invention may be explained with reference to the drawings, in which.

DETAILED DESCRIPTION

Figure 2:
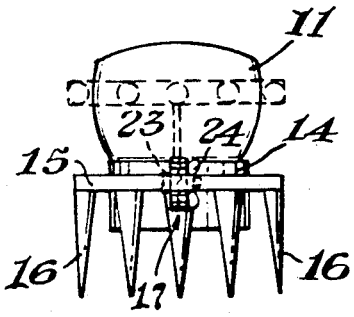
FIG. 2 is a rear elevational view corresponding fragmentarily to FIG. 1, showing the rear portion of the shoe with the rake accessory in both lowered and elevated positions.

In a preferred embodiment (FIGS. 1 to 3), the rake accessory of the invention is attached to a conventional golf shoe 11. Customary flanged spikes 12 are set in the bottom of the outsole 13 and heel 14. The rake portion per se of the accessory comprises a metal horizontal rake bar 15 into which metal tines 16 are inset. The rake is mounted in position transverse to the shoe 11 and rearward of the heel 14. The length of the bar 15 is such that the rake is about the width of the heel 14 or slightly greater. When the rake is in the lowered or operative position (FIGS. 1 and 2, solid lines) the tines 16 extend well below the level of the bottom of the heel 14 to provide good raking contact with the ground. In the raised or inoperative position (FIGS. 1 and 2, dotted lines) the tines 16 are clear of the ground. Choice between the positions is made by adjustable pivot means, indicated generally as 17 (to be described).

The rake assembly is attached to the shoe by a metal mounting which includes a spike or prong 18. This prong is driven tightly into a corresponding hole 19 bored longitudinally into the heel 14. The prong 18 merges rearwardly into (and is integral with) a metal disk 20 constituting the stationary side of the pivot means 17. Mating with the disk 20 is a similar disk 21 which is the movable part of the pivot means. This disk 21 merges rearwardly into (and is integral with) a stem 22 which in turn is attached fixedly to the rake bar 15.

The disks 20 and 21 constitute a matched pair held together face to face by adjustable locking means. Adjustability and locking are provided by a headed pivot bolt 23 (FIG. 3) which extends axially through mating holes centered in the disks. Compression means, such as a wing nut 24, is threaded on the bolt 23. The nut can be tightened to hold the disks firmly together, thereby keeping the rake in fixed position relative to the shoe. The nut can also be released to allow adjusting the rake bar from raised to lowered mode, or vice versa. To afford added rigidity when the disks are locked together, the mating faces of the disks may be formed with a series of interfitting radial grooves and ridges (seen edgewise as notches, especially in FIG. 3).

Figure 1:
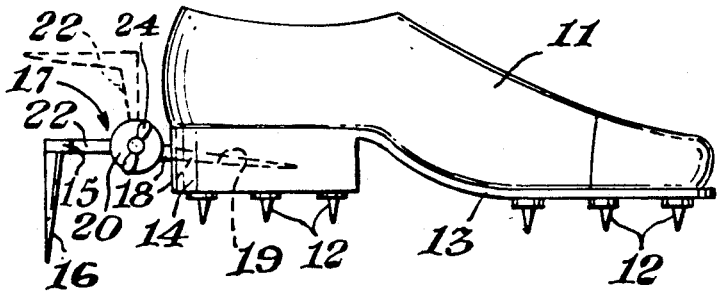
FIG. 1 is a side elevational view of a golf shoe fitted with a rake accessory embodying the present invention, showing the rake in lowered position (solid lines) and in elevated position (dotted lines)
Figure 3:
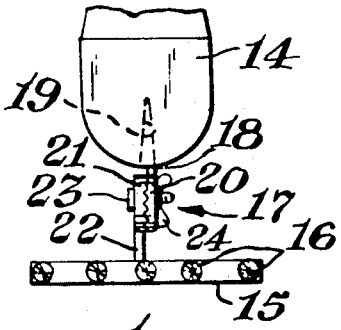
FIG. 3 is a fragmentary bottom view corresponding to FIGS. 1 and 2, looking upward and showing the rear portion of the shoe with the rake in lowered position.

FIGS. 1 to 3 illustrate the invention attached to the right-foot shoe of a pair of golf shoes. For the left-foot shoe, the arrangement of parts is the same, except that it is the mirror image (not shown).

Figure 4:
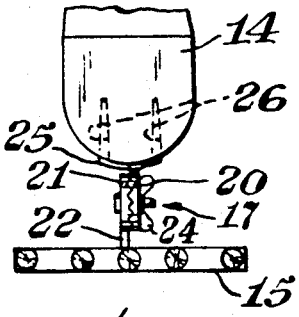
FIG. 4 is a fragmentary bottom view of a golf shoe and accessory corresponding generally to FIG. 3 but illustrating an alternative two-pronged mounting for the rake.

An alternative mounting for the rake accessory of the invention is shown in FIG. 4 and provides extra sturdiness. The overall construction is the same as in FIGS. 1 to 3 with the exception of the heel mounting. In FIG. 4, this mounting 25 is double-pronged or U-shaped and is drive-fitted into parallel holes 26 in the heel 14. The double-prong merges rearwardly into the disk 20 (and is integral with it).

With the embodiments of FIGS. 1 to 4, each rake 15 per se can be removed from the shoes if desired by withdrawing the pivot bolt 23 and separating the mating disks 20 and 21. However, the spike mountings 18 or 25 and stationary disks 20 cannot readily be detached but remain permanently anchored to the shoes throughout their life.

Figure 5:
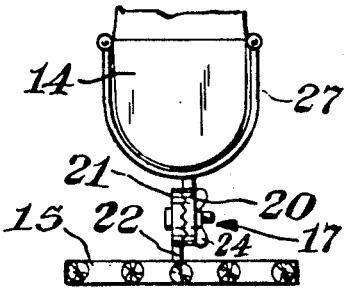
FIG. 5 is a fragmentary bottom view of a golf shoe showing an alternative embodiment of the invention in which the rake accessory is easily removable from the shoe, being mounted on a spur assembly encircling the heel.
Figure 6:
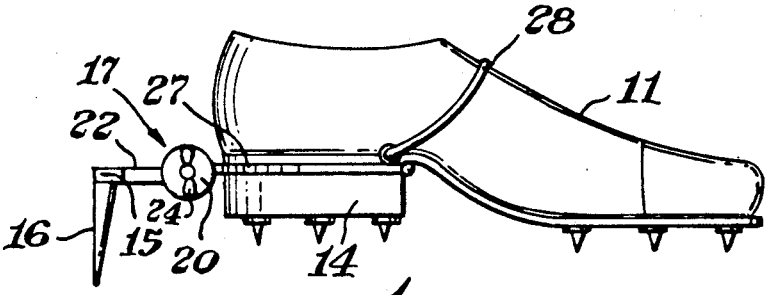
FIG. 6 is a side elevational view, complementary to FIG. 5, showing the means of strapping and securing the spur-like mounting to the golf shoe.

When a fully detachable mounting is wanted, resort may be had to the alternative construction shown in FIGS. 5 and 6. In this, the rake assembly is held in place on the shoe by a metal spur assembly 27 which encircles the shoe heel 4. The spur assembly merges rearwardly and integrally with the stationary disk 20. A releasable adjustable leather strap 28 secured to the spur assembly may be drawn tight over the instep of the shoe. In this way, the entire rake assembly is held securely in place, fully usable. If it is desired to remove the rake assembly, the strap 28 is loosened. The spur assembly 27 may then simply be slipped off the heel. With it the whole rake assembly and mounting comes off, leaving the shoe entirely unencumbered.

The invention, in all its embodiments illustrated, serves adequately for smoothing out depressions in golf course sand traps. In use, a rake accessory is fitted tightly to each golf shoe in one of the manners described. The player then puts on the shoes or the detachable spur assemblies and raises each rake to the elevated inoperative position clear of the ground, by adjusting and locking the pivot means 17. The player is then free to walk about the golf course in the usual way. If the player later must enter a sand trap and wishes to activate the sand smoothing action, he or she lowers the rake on each shoe to operative position in contact with the ground. This is accomplished by unlocking the pivot means 17, lowering each rake, and locking the pivots to hold the rakes securely down. The player then strides into and subsequently out of the trap. The resulting raking action keeps the sand smooth, instantly leveling any footprints made by the walking of the player and any other depressions. On leaving the trap, the player again raises and locks each rake into the raised position to resume easy walking.

The foregoing detailed description of the invention is intended as representative only of best modes known to applicant. Numerous modifications and variations may be made within the spirit of the invention and the scope of the following claims.

What is claimed is:

1. For attachment to a golf shoe having a heel, an accessory for smoothing out depressions in a golf course sand trap comprising a tined rake about the width of the shoe heel, a mounting for the rake adapted to secure it to the shoe in a transverse position rearward of the heel, the mounting including pivot means allowing adjustment of the rake from a lowered position in raking contact with the ground to a raised position clear of the ground, the pivot means comprising a mating pair of opposed disks, one disk being stationary and secured to the shoe mounting and the other disk being movable and secured to the rake, the mating disks being compressed together by adjustable locking means comprising a pivot bolt extending axially through mating holes centered in the disks, and compression means on the bolt manually tightenable to lock the disks together.

2. An accessory according to claim 1 in which the rake mounting is formed with at least one prong adapted to fit tightly into a hole bored into the shoe heel.

3. An accessory according to claim 2 in which the prong merges rearwardly into the mating disk constituting the stationary part of the pivot means.

4. An accessory according to claim 1 in which the rake mounting is a spur assembly encircling the heel and strapped to the shoe, the spur assembly merging rearwardly into the stationary disk constituting the stationary part of the pivot means.

5. For attachment to a golf shoe having a heel, an accessory for smoothing out depressions in a golf course sand trap comprising a ground rake formed of a horizontal bar in which tines are inset, the length of the bar being about the width of the shoe heel, a mounting for the rake adapted to secure it to the shoe in a transverse position rearward of the heel, the mounting including pivot means allowing adjustment of the rake from a lowered position in raking contact with the ground to a raised position clear of the ground, the pivot means comprising a mating pair of opposed disks, one disk being stationary and secured to the shoe mounting and the other disk being movable and secured to the rake bar, the mating faces of the disks being formed with a series of interfitting radial grooves and ridges, the mating disks being compressed together by adjustable locking means comprising a pivot bolt extending axially through mating holes centered in the disks, and compression means on the bolt manually adjustable to lock the disks together.

6. An accessory according to claim 5 in which the stationary disk is formed integrally with at least one prong adapted to fit tightly into a hole bored longitudinally into the shoe heel.

7. An accessory according to claim 5 in which the stationary disk merges integrally with a spur assembly formed to encircle the heel and be strapped to the shoe.

* * * * *